US006614913B1

(12) United States Patent
Allen

(10) Patent No.: US 6,614,913 B1
(45) Date of Patent: Sep. 2, 2003

(54) VEHICLE SPEAKER POD

(76) Inventor: Stuart Allen, 115 Landenberg Rd., Ste. No. 3, Landenberg, PA (US) 19350

( * ) Notice: Subject to any disclaimer, the term of this patent is extended or adjusted under 35 U.S.C. 154(b) by 197 days.

(21) Appl. No.: 09/599,109

(22) Filed: Jun. 22, 2000

(51) Int. Cl.[7] ..... H04R 25/00
(52) U.S. Cl. ..... 381/389; 381/86; 181/150
(58) Field of Search ..... 381/86, 302, 389; 181/149, 150; 49/501, 502

(56) References Cited

U.S. PATENT DOCUMENTS 4,905,860 A * 3/1990 Kurihara et al. ..... 381/86
4,917,212 A * 4/1990 Iwaya ..... 381/389
5,414,229 A * 5/1995 Rocheleau et al. ..... 381/389
6,226,927 B1 * 5/2001 Bertolini et al. ..... 181/150

* cited by examiner

*Primary Examiner*—Curtis Kuntz
*Assistant Examiner*—Suhan Ni

(74) *Attorney, Agent, or Firm*—RatnerPrestia

(57) ABSTRACT

A speaker pod for housing an audio speaker. The speaker pod is adapted to be installed in a channel having an effective height and a depth defined by a floor, a sidewall, and a top, such as may be found, for example, below the door-frame of a 1997-model-year Jeep® Wrangler® vehicle. The speaker pod comprises a multi-sided enclosure having a back plate adapted to extend upwardly from the floor adjacent to and approximately parallel to the sidewall, a front plate having a projected height and an opening for mounting a speaker therein, and a top connecting the back plate with the front plate. The top has a step comprising a bottom having a width approximately equal to the depth of the channel and a riser having a height approximately equal to the projected height of the front plate minus the effective height of the channel. The speaker pod may be particularly adapted for mounting in the front compartment of a vehicle and the front plate may be angled relative to the back plate to direct sound from the speaker toward a driver or a passenger in the vehicle. The invention also comprises a vehicle having at least one speaker pod as claimed herein, preferably with a set of two speaker pods that are mirror-images of one another and mounted on opposite sides of the vehicle.

9 Claims, 3 Drawing Sheets

VEHICLE SPEAKER POD

TECHNICAL FIELD

This invention relates to speaker cabinets, and more particularly to speaker cabinets for vehicles.

BACKGROUND OF THE INVENTION

The thrill of riding in a convertible with the top down and the stereo blasting is one that is enjoyed by many. A multitude of different types of stereos and speakers are available from the original equipment manufacturers (OEM) of automobiles, usually tailored to the specific design of the vehicle. A further multitude of different types of stereos and speakers are available from after-market suppliers, providing versatile stereos and speakers that can be installed in almost any vehicle by a skilled owner or after-market installer. Typically, the stereo speakers intended to supply sound to the front compartment of the car are mounted in the opposite doors of the car.

Certain models of sports utility vehicles, for example, the Jeep® Wrangler® vehicle, have removable doors for an even greater feeling of openness than is enjoyed by merely having the top down. Such doors, however, are not conducive to having stereo speakers installed in them because once the doors are removed, the speakers would be gone and any speaker wire connecting to the speakers would have to be disconnectable. There are several options available to the owners of such vehicles to provide stereo sound, none of which are satisfactory. For example, it is known to mount speakers to the roll bars, such as is described in U.S. Pat. No. 5,608,806. It is also known to mount speakers between the roll bar and the fender well, which typically provides sound to the rear compartment of the vehicle, or to install an overhead soundbar containing speakers therein. It is also known to provide consoles mounted under the dash between the driver and passenger that provide speakers as well as storage and drink-holding capacity. Such designs are showcased in catalogs of after-market products for Jeep® Vehicles, published for example, under the names Quadratec, J. C. Whitney, and Four Wheel Drive Hardware, or enthusiast's periodicals such as JP Magazine. Roll-bar mounted speakers, as described in the '806 patent, or speakers mounted between the roll bar and fender well, provide sound to the rear of the vehicle, but not to the front. Although an overhead soundbar can be mounted to provide sound to the front compartment of the vehicle, the sound essentially blares right above the ears of the driver and front passenger.

None of the above solutions, however, provides the ideal stereo sound that is provided by having speakers on either side of the car in the front passenger compartment. Thus, there is still a need in the industry to provide speaker cabinets tailored to fit the structures of off-road vehicles with convertible doors.

SUMMARY OF THE INVENTION

The present invention comprises a speaker pod for housing an audio speaker, the speaker pod adapted to be installed in a vehicle having a channel having an effective height and a width defined by the floor, a sidewall, and a top. The speaker pod comprises a multi-sided enclosure having a back plate to extend upwardly from the vehicle floor adjacent to and approximately parallel to the sidewall, a front plate having a projected height and an opening for mounting a speaker therein, and a top connecting the back plate with the front plate. The top has a step with a width approximately equal to the depth of the top of the channel and a riser having a height equal to the projected height of the front plate minus the effective height of the sidewall. The front plate is typically angled relative to the back plate to direct sound from the speaker toward a driver or a passenger in the vehicle.

The speaker pod has a forward-facing side facing the front of the vehicle and a backward-facing side facing the rear of the vehicle. The front plate has a forwardfacing end adjacent the forward-facing side and a backward-facing end adjacent the backward-facing side. The forward-facing end of the front plate may be semi-circular and the backward-facing end of the front plate may have a diagonal truncation in a lower portion thereof. The forward-facing end of the front plate may extend further forward in the vehicle than the forward-facing end of the back plate.

The speaker pod is typically adapted for mounting in a convertible off-road vehicle, such as a vehicle having channel dimensions equal to the channel dimensions of a 1997-model-year Jeep® Wrangler® vehicle, and may be particularly adapted for mountng in the front compartment of the vehicle for providing sound to the front compartment.

The invention also comprises a set of two speaker pods as described above, each comprising a mirror-image of the other. The invention further comprises a vehicle comprising at least one speaker pod of this invention.

DETAILED DESCRIPTION OF INVENTION

The invention will next be illustrated with reference to the figures wherein similar numbers indicate the same elements in all figures. Such figures are intended to be illustrative rather than limiting and are included herewith to facilitate the explanation of the apparatus of the present invention.

Figure 1:
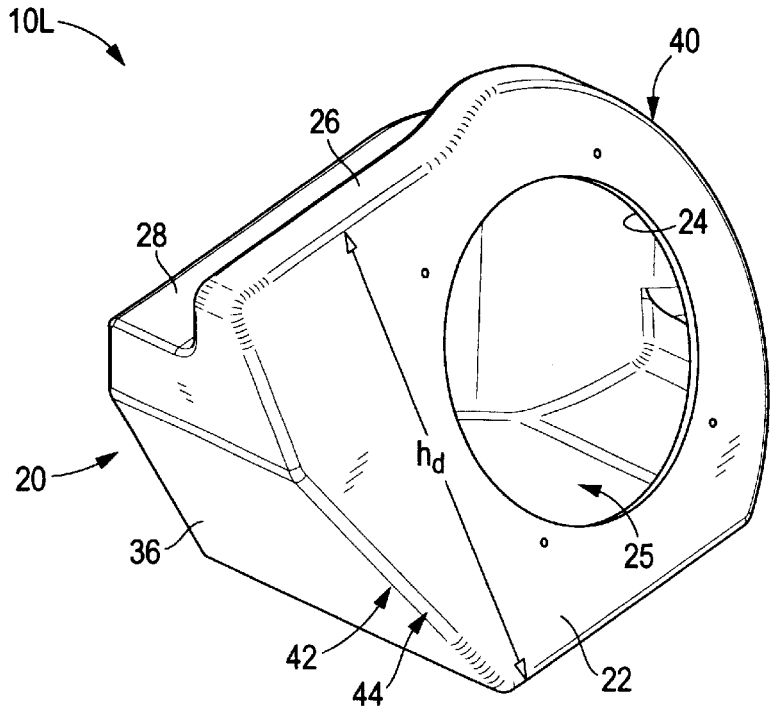
FIG. 1 is a perspective view of a pair of exemplary speaker pods according to the present invention.
Figure 1:
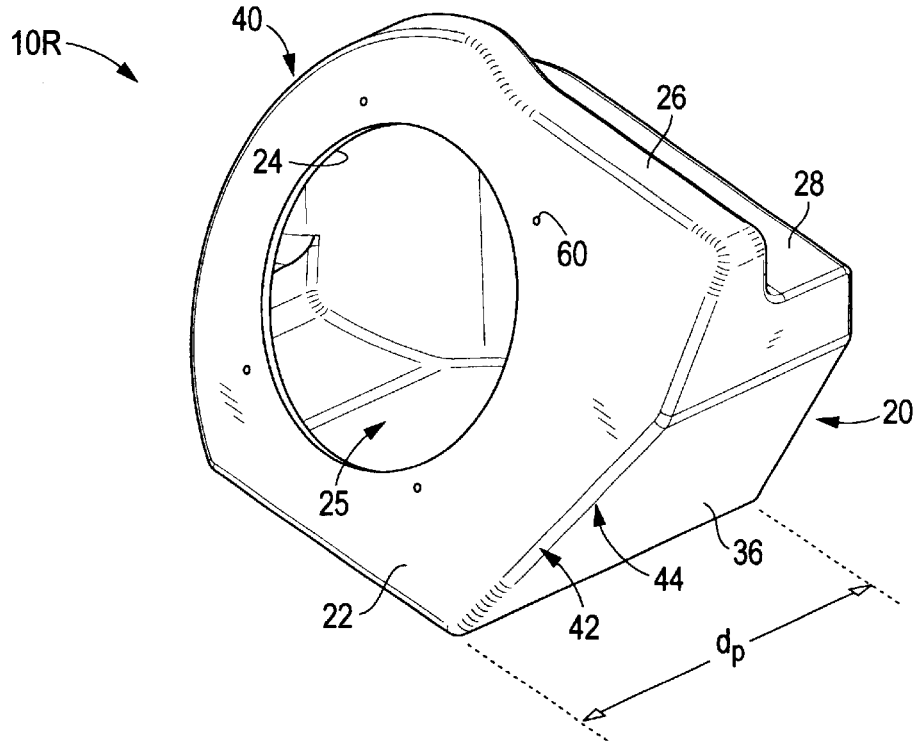
Figure 2:
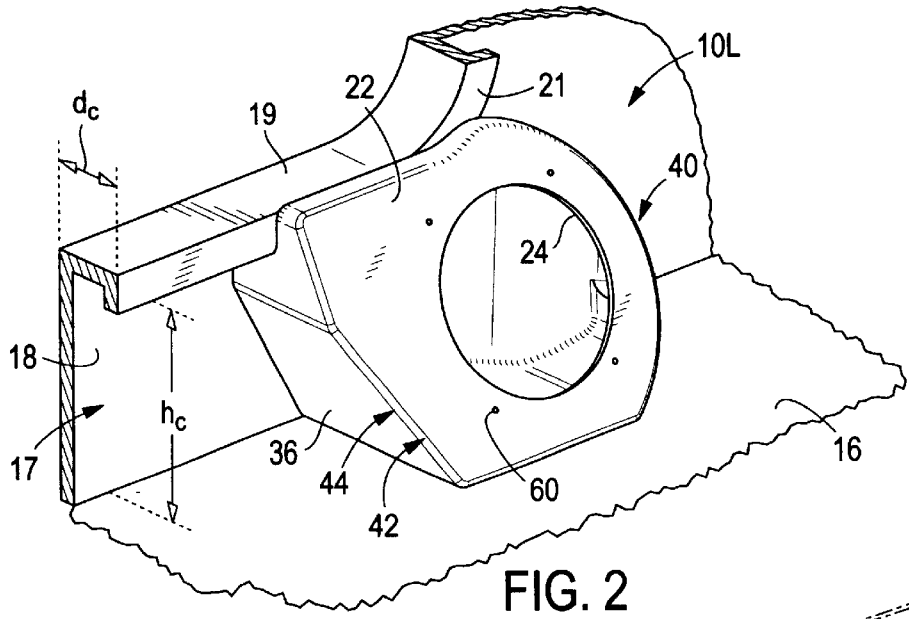
FIG. 2 is an illustration of an exemplary placement of a driver's side speaker pod of this invention in a typical vehicle.

Referring now to FIGS. 1–6, there are shown exemplary speaker pods 10L and 10R, each for housing an audio speaker 12 (shown in FIG. 2) according to the present invention. Speaker pods 10L and 10R are adapted to be installed in a vehicle 14 having a floor 16 and a channel 17 defined by the floor, sidewall 18, top 19, and optionally, overhang 21. Speaker pods 10L and 10R are mirror-images of one another. Speaker pod 10L is adapted to be mounted on the left-hand side of vehicle 14 as shown in FIG. 2, whereas speaker pod 10R is adapted to be mounted on the right-hand side (not shown, but a mirror image of the view shown in FIG. 2). The left hand side and right hand side as referred to herein relate to the orientation when sitting in the vehicle facing forward. Channel 17 has an effective height $h_c$ from floor 16 to the bottom edge of overhang 21 and a depth $d_c$.

Figure 3:
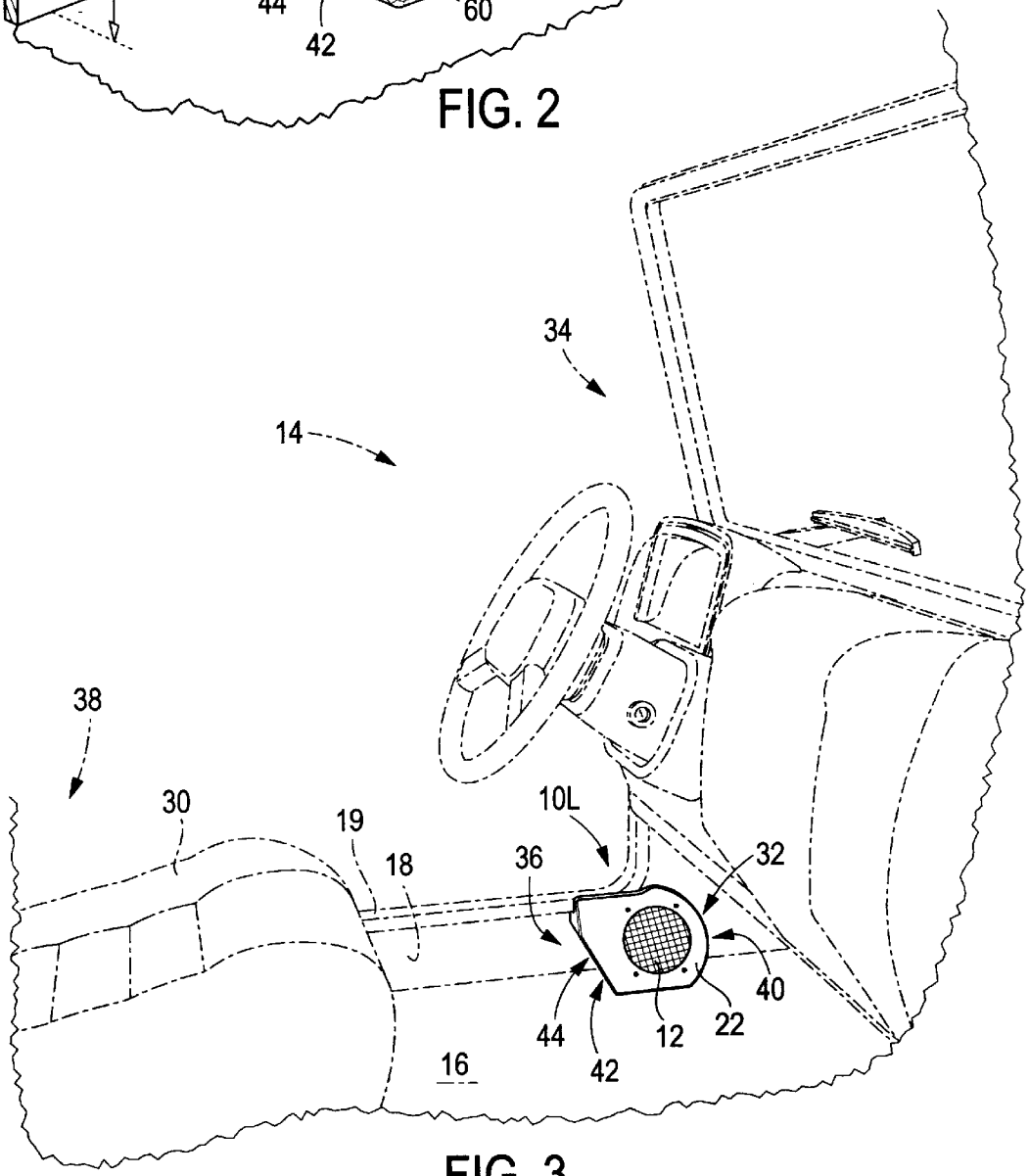
FIG. 3 is a detailed illustration of an exemplary placement of the driver's side speaker pod of FIG. 2, showing a cross-section of an exemplary vehicle channel.
Figure 4:
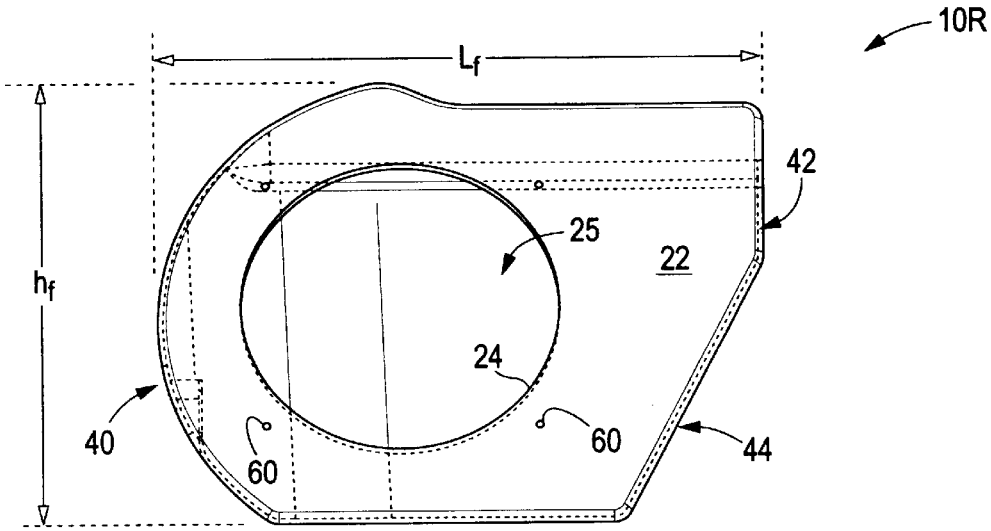
FIG. 4 is a front view of a passenger's side speaker pod.

"Effective height" is defined to mean the height of the channel as viewed from the open side of the channel opposite sidewall 18. As depicted in FIG. 3, the effective height is typically the height from floor 16 to top 19 minus the height of overhang 21. In channels without an overhang (not shown), the effective height is the height from the floor to the channel top. In the case of a 1997 or later model year Jeep® Wrangler® vehicle, overhang 21 is relatively small, comprising merely a turned under section where the sheet metal that forms channel 17 is bent under to eliminate any sharp edges from being exposed. The channel cross-sectional geometry shown in FIG. 3 is not intended to be limiting, however, and thus the configuration of the overhang may comprise any number of geometric configurations.

Speaker pods 10R and 10L each comprise a multi-sided enclosure. Back plate 20 is adapted to extend from,the vehicle floor 16 approximately parallel to and adjacent to sidewall 18 to approximately effective height $h_c$. Front plate 22 has a projected height $h_f$ and an opening 24 for mounting a speaker 12 therein. The term "projected height" as used herein means the height as projected on a vertical surface. Thus, where front plate 22 is angled diagonally to vertical V at an angle $\alpha$, as is best depicted in the side view of FIG. 6, projected height $h_f=h_d(\cos\alpha)$. Where front plate 22 is not angled, then $h_d=h_f$. Top 26 connects back plate 20 with front plate 22 and has a step 28 therein. Step 28 has a bottom 29 having a width $w_s$ approximately equal to depth $d_c$ of channel 17 and a riser 31 having a height $h_r$ approximately equal to projected height $h_f$ of front plate 22 minus effective height $h_c$ of the channel.

As used herein, "approximately" means that the dimensions of the speaker pod are necessarily somewhat less than the dimensions of the channel so that the speaker pod may fit within the channel. The approximate dimensions may be such that the fit between speaker pod 10L or 10R and the channel 17 is a snug fit or loose fit, depending on the tolerances of the channel in the vehicle, the tolerances in the manufacturing process for the speaker pod, and the amount of clearance desired between back plate 20 and step 28 of the speaker pod and sidewall 18 and overhang 21 of channel 17.

Front plate 22 is angled relative to back plate 20, typically to direct sound from speaker 12 toward the ear-level of a driver (not shown) sitting in seat 30 or a passenger sitting on the opposite seat in the vehicle. The angle of speaker pod 10L directs sound to the passenger on the right-hand side of the vehicle and the angle of speaker pod 10R directs sound to the driver on the left-hand side of the vehicle. The locations of the driver and passenger are given herein for the traditional driver-on-the-left-hand side configuration of vehicles in the United States, but the driver may be on either side of the vehicle without affecting the scope of this invention. Because back plate 20 is essentially vertical, the angle,of front plate 22 relative to the back plate is the same as angle $\alpha$ of the front plate to vertical shown in FIG. 6. In a preferred embodiment designed for a 1997 Jeep® Wrangler® vehicle, angle $\alpha$ is approximately 27°, but may be more or less depending on the width of the vehicle and the ear-level height of a typical driver or passenger in the vehicle.

Figure 5:
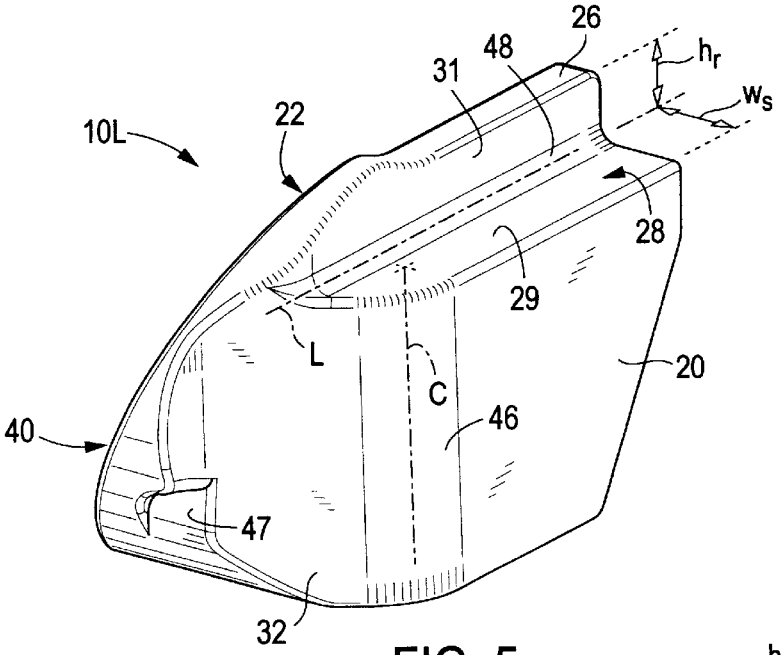
FIG. 5 is a back perspective view of a driver's side speaker pod.
Figure 6:
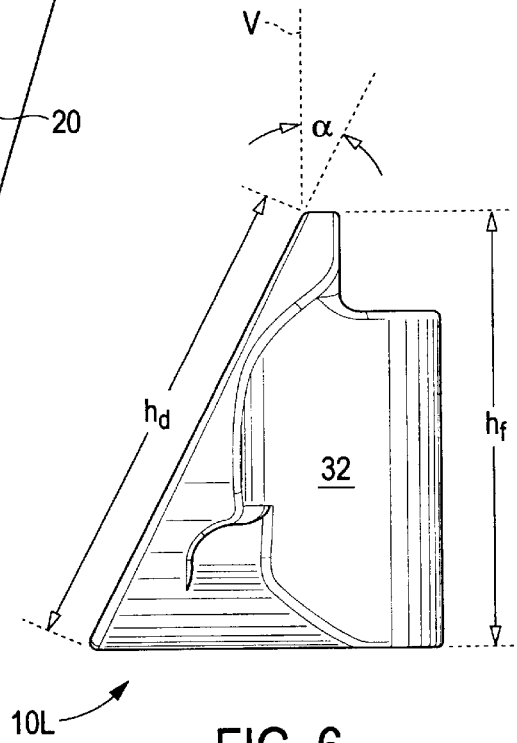
FIG. 6 is a forward-facing-side view of a driver's side speaker pod.

Speaker pods 10L and 10R each further comprise a forward-facing side 32 facing front 34 of the vehicle and a backward-facing side 36 facing rear 38 of vehicle 14. Front plate 22 has a corresponding forward-facing end 40 adjacent forward-facing side 32 and a backward-facing end 42 adjacent backward-facing side 36. Forward-facing end 40 of front plate 22 is semi-circular and backward-facing end 42 of the front plate has an diagonal truncation 44 in the lower portion thereof. Forward-facing end 40 of front plate 22 extends further forward than forward-facing end 46 of the back plate, as shown in FIG. 5. As shown in FIG. 5, where there is a rounded transition between back plate 20 and forward-facing side 32, the forward-facing end 46 of back plate may be envisioned as extending to centerline C of the radius of the rounded transition. A support brace 47 may be provided between forward-facing side 32 and forward facing end 40 of front plate 22.

As speaker pods 10L and 10R are typically adapted for mounting in a convertible off-road vehicle where they may be exposed to the weather, they typically comprise waterproof materials: and have a watertight construction. Exemplary materials are fiberglass or thermoplastic resin, but any material known in the art may be satisfactory for a particular application.

Although speaker pods of the present invention may be adapted for mounting in any type of vehicle, the need is greatest in convertible off-road vehicles having removable doors, and in particular, Jeep® Wrangler® vehicles. The channel dimensions effective height $h_c$ and depth $d_c$ for the Jeep® Wrangler® vehicle design first introduced in the 1997 model year are particularly well-suited for installation of speaker pods of the present invention. The overall dimensions of an exemplary speaker pod adapted for mounting a 5¼ inch diameter, speaker therein is a projected height $h_f$ of 6.11 inches, a length $L_f$ of 8.62 inches, and a depth $d_p$ of 4.72 inches. The step typically has a width $w_s$ of approximately 1½ inches and a height $h_r$ of approximately 1 3/16 inches. As shown in FIG. 5, step 28 may have a rounded transition 48 between bottom 29 and riser 31, and thus the height $h_r$ and width $w_s$ are measured from the imaginary cornerline L formed where the bottom and riser would come together without the rounded transition.

Speaker pods of these dimensions fit within channel 17 of 1997-model-year Jeep® Wrangler® vehicles while also providing a profile that does not extend too far toward the gas and brake pedals on the driver's side and that is flush with the top of the channel so as not to create a tripping hazard for the driver or passenger getting in and out of the car. Although such dimensions are preferable for the 1997-model-year Jeep® Wrangler® vehicle, it should be recognized that any dimensions, including larger or smaller diameter speakers, may be provided to meet the needs of consumers for any vehicle for which such speaker pods are desired. It should also be noted that the speaker pod of the present invention, although adapted specifically for use in vehicles having a channel, may also be well-suited for other applications outside of vehicles where there is a need to provide a step in the top of a speaker cabinet to accommodate placement of the back plate of the pod in some sort of channel.

Although shown herein with rounded transitions between back plate 20 and forward-facing side 32 and between bottom 29 and riser 31 of step 28, these transitions may be square or even more rounded, if desired. The design of forward-facing end 40 of front-plate 22 may be semicircular and the backward-facing end 42 may have a diagonal truncation 44 as depicted in FIGS. 1–5, or these ends may conform to some other geometry as desired. These particular features are beneficial for the preferred application in a 1997-model-year and like design Jeep® Wrangler® vehicles because they minimize hard edges that may be caught by the driver's or passenger's feet while entering or leaving the vehicle. Such specific geometric features may be omitted, or other geometric features may be substituted, as desired.

The configuration of step 28 is shown in FIG. 5 as being essentially square with a rounded transition between bottom 29 and riser 31. The step may have any geometry, however, that conforms to the geometry of channel 18 and that provides a transition between back plate 20 and front plate 22 and that provides an internal cavity 25 with a geometry sufficient to allow insertion of the internal components (not shown) of speaker 12, which are typically contained in a conical shape.

Although developed for mounting in a front compartment of the vehicle to provide sound to the front compartment of the vehicle, speaker pods of this invention can be used wherever such pods provide a benefit. Similarly, although developed specifically to meet the design of 1997-model-year Jeep® Wrangler® vehicles, speaker pods of the present invention may be used on any vehicle in which the need for such a speaker pod arises, including earlier Jeep® Wrangler® models and off-road and on-road vehicles of other automakers. Although the 1997-model-year design is still the design in production as of the date of filing this application, even as modifications in the channel design in models subsequent to the 1997-model-year of the Jeep® Wrangler® may occur, minor changes in the geometry and dimensions of the speaker pod to accommodate such modifications may be made without departing from the scope of the present invention.

Although preferably sold as a set of two speaker pods 10L and 10R that are mirror images of one another, the pods may also be sold separately. In addition to making the speaker pods of this invention available to after-market buyers, it is also within the present invention to provide speaker pods to original equipment manufacturers (OEMs) for sale as an integral part of a vehicle from the factory.

Although not shown herein, the speaker pod typically has a cutout somewhere on one of the side walls, top, or back plates to provide a place where wiring can run from the appropriate connecting points in the vehicle to provide power and the audio signal to the speaker. Furthermore, each pod also may typically have mounting holes therein or mounting hardware attached thereto for securing the pod to the vehicle. Finally, the pod also has a set of screw holes 60 for securing the speaker to the pod, the screw holes spaced as necessary to match the standard spacing for the attachment hardware of speakers known in the art. It may further be desired to provide indentations, wiring channels, or additional features as necessary to provide a speaker pod that conforms to the shape of the channel in which it is to be installed.

Those skilled in the art having the benefit of the teachings of the present invention as hereinabove set forth, can effect numerous modifications thereto. These modifications are to be construed as being encompassed within the scope of the present invention as set forth in the appended claims.

What is claimed:

1. A speaker pod for housing an audio speaker, the speaker pod adapted to be installed in a vehicle having a channel with an effective height and a width, the channel defined by a floor, a sidewall connected to the floor, a top connected to the sidewall, and, optionally, an overhang, the speaker pod comprising a multi-sided enclosure that comprises:

a forward-facing side adapted to face a front of the vehicle;

a backward-facing side adapted to face a rear of the vehicle;

a back plate adapted to extend upwardly from the floor adjacent to and approximately parallel to the sidewall;

a front plate having a projected height, an opening for mounting a speaker therein, a forward-facing end adjacent the forward-facing side, and a backward-facing end adjacent the backward-facing side, the front plate comprising at least one of: a diagonal truncation in a lower portion of the backward-facing end or a semi-circular forward-facing end of the front plate; and a top plate connecting the back plate with the front plate and having a step therein, the step comprising a bottom having a width approximately equal to the depth of the channel and a riser having a height approximately equal to the projected height of the front plate minus the effective height of the channel.

2. The speaker pod of claim 1 wherein the front plate is angled relative to the back plate.

3. The speaker pod of claim 2 wherein the front plate is angled relative to the back plate at an angle of approximately 27°.

4. The speaker pod of claim 1 wherein the front plate comprises both the semi-circular forward-facing end and the diagonal truncation in the lower portion of the backward-facing end.

5. The speaker pod of claim 4 wherein the forward-facing end of the front plate is adapted to extend further forward in the vehicle than a forward-facing end of the back plate.

6. The speaker pod of claim 1 wherein the speaker pod is waterproof.

7. The speaker pod of claim 1 further comprising a speaker mounted in the opening in the front plate.

8. A speaker pod for housing an audio speaker, the speaker pod adapted to be installed in a vehicle having a channel with an effective height and a depth, the channel defined by a floor, a sidewall connected to the floor, a top connected to the sidewall, and, optionally, an overhang, the speaker pod comprising a multi-sided enclosure that comprises:

a forward-facing side adapted to face a front of the vehicle;

a backward-facing side adapted to face a rear of the vehicle;

a back plate having a forward-facing end and adapted to extend upwardly from the floor adjacent to and approximately parallel to the sidewall;

a front plate having a projected height and an opening for mounting a speaker therein, the front plate angled relative to the back plate and having a semi-circular forward-facing end adjacent the forward-facing side, a backward-facing end adjacent the backward-facing side, and a diagonal truncation in a lower portion thereof, the forward-facing end of the front plate adapted to extend further forward in the vehicle than the forward-facing end of the back plate; and a top connecting the back plate with the front plate and having a step therein, the step comprising a bottom having a width approximately equal to the depth of the channel and a riser having a height approximately equal to the projected height of the front plate minus the effective height of the channel.

9. The speaker pod of claim 8 wherein the speaker pod is adapted for mounting in a channel having a channel effective height and channel depth approximately equal to a channel in a front compartment of a 1997-model-year Jeep® Wrangler® vehicle.

* * * * *

UNITED STATES PATENT AND TRADEMARK OFFICE

CERTIFICATE OF CORRECTION

PATENT NO. : 6,614,913 B1
DATED : September 2, 2003
INVENTOR(S) : Stuart Allen

It is certified that error appears in the above-identified patent and that said Letters Patent is hereby corrected as shown below:

Title page,

Item [56], References Cited, U.S. PATENT DOCUMENTS, insert the following:

| | | |
|---|---|---|
| -- 4,277,653 | 07/07/81 | Pawelzick |
| 4,602,382 | 07/22/86 | Gabbay et al. |
| 5,608,806 | 03/04/97 | Hinojosa -- |

OTHER PUBLICATIONS, insert the following:

-- J.C. Whitney, Everything Automotive Jeep® C J & Wrangler Catalog No. 235, p. 16
Quadratec Spring 2000 Essentials for Jeep® Vehicles Catalog 029A, p. 38
Four Wheel Drive Hardware® Fall/Winter 1999 Catalog, p. 27
JP Magazine, May 2000, p. 102 --

Signed and Sealed this

Twenty-fifth Day of November, 2003

JAMES E. ROGAN
*Director of the United States Patent and Trademark Office*